US006739147B1

(12) United States Patent
Sishtla

(10) Patent No.: US 6,739,147 B1
(45) Date of Patent: May 25, 2004

(54) ALTERNATE FLOW OF DISCHARGE GAS TO A VAPORIZER FOR A SCREW COMPRESSOR

(75) Inventor: Vishnu Mohan Sishtla, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/306,326

(22) Filed: Nov. 27, 2002

(51) Int. Cl.[7] ..... F25B 43/02; F25B 31/00
(52) U.S. Cl. ..... 62/192; 62/84
(58) Field of Search ..... 62/192, 84

(56) References Cited

U.S. PATENT DOCUMENTS 6,182,467 B1 * 2/2001 Zhong et al. ..... 62/470
6,216,474 B1 * 4/2001 Sishtla ..... 62/84
6,550,258 B1 * 4/2003 Shoulders ..... 62/84

* cited by examiner

*Primary Examiner*—William C. Doerrler
*Assistant Examiner*—Filip Zec
(74) *Attorney, Agent, or Firm*—Carlson, Gaskey & Olds

(57) ABSTRACT

A system for reclaiming oil from a combined refrigerant/oil liquid mixture at an evaporator takes a tap of discharge pressure refrigerant from a screw compressor. This hot refrigerant is utilized to boil off refrigerant in the combined liquid refrigerant/oil mixture in a vaporizer. The separated oil is returned to an oil sump and utilized to lubricate the compressor. The tapped discharge pressure refrigerant can be tapped from two distinct locations, and each of these taps receives a valve. The two valves are controlled based upon system conditions. The two valves are selectively opened and closed to provide the hottest temperature refrigerant to the vaporizer to achieve the maximum separation efficiency.

15 Claims, 2 Drawing Sheets

ALTERNATE FLOW OF DISCHARGE GAS TO A VAPORIZER FOR A SCREW COMPRESSOR

BACKGROUND OF THE INVENTION

This invention relates to an improved system for reclaiming or separating the oil from a refrigerant in a screw compressor refrigerant system.

In one system recently developed by the Assignee of the present invention, a heated refrigerant from the compressor passes through a reclaim flow vaporizer to separate oil and refrigerant drained from the evaporator. The separated oil is returned to an oil sump, and utilized to again lubricate the components of the compressor. This provides higher viscosity oil.

The basic structure of the reclaimed flow vaporizer taps a discharge refrigerant from a location within, or slightly downstream, the screw compressor that is likely to be quite hot. This discharge refrigerant passes through the reclaim flow vaporizer. A liquid refrigerant/oil mixture from the evaporator is also sent through the reclaim flow vaporizer, but separated from the discharge refrigerant tap. The hot discharge refrigerant boils off the refrigerant in this liquid mixture from the evaporator cooler. The remaining oil is returned to an oil sump.

While the above-referenced system has benefits, under certain operational conditions the tapped refrigerant from a location within or outside the screw compressor side chamber may not be sufficiently hot to efficiently perform the boiling off function. In particular, at different loads, the temperature of this discharge gas is low and hence not as effective as would be desirable.

SUMMARY OF THE INVENTION

In a disclosed embodiment of this invention, alternative valves are placed into the system to control the flow of the compressed refrigerant back to the reclaimed flow vaporizer. One alternative line leads from the last pocket of the screw compressor, as was the case in the above-referenced system. The valve is placed on this line and is operable through a control. A second tap leads from the main discharge line and also passes through a selectively open valve also controlled by the control. The control determines which of the two valves should be opened to provide the optimum highest temperature refrigerant to the reclaimed full vaporizer. In a situation where the compressor is operating at the proper amount of compression at full load, or where there is over compression, the maximum temperature will occur in a chamber associated with the last "lobe" of the screw compressor. Thus, under those situations the control will preferably open the valve tapping the discharge refrigerant from that chamber.

However, when there is under compression the valve controlling the line from the chamber is closed and the valve directly from the discharge line is opened. The refrigerant from the discharge line will typically have a higher temperature under this condition. Typically, the control will lower the load on the compressor in this under-compression situation (that is, the compressor will be driven at a slower speed). Eventually, the pressure from the compressor will reach the design pressure for this lower load situation. At that time, the valve from the last compression chamber will again be opened, and the valve from the discharge line will again be closed.

The present invention thus ensures that an optimum temperature refrigerant is utilized to reclaim oil from a liquid refrigerant/oil mixture.

These and other features of the present invention can be best understood from the following specification and drawings, the following of which is a brief description.

DETAILED DESCRIPTION OF THE PREFERRED EMBODIMENT

Figure 1:
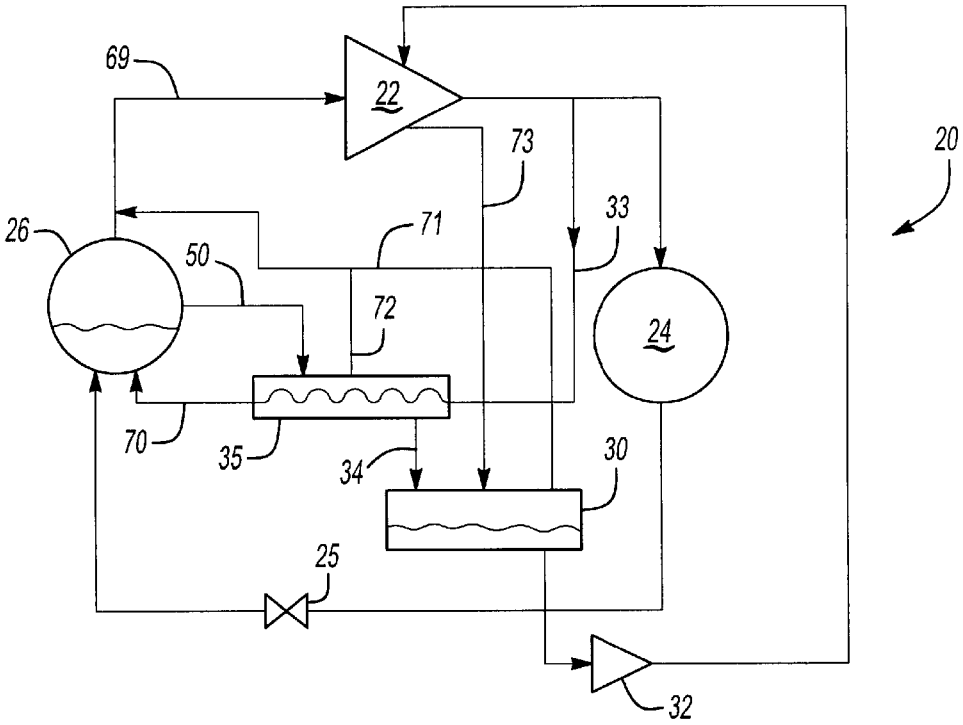
FIG. 1 shows the existing system which taps the refrigerant from the last compressor chamber.

A system 20 is illustrated in FIG. 1. System 20 is a recently developed system which is the subject of a separate patent application entitled "Oil Recovery and Lubrication System for a Screw Compressor" and filed on even date herewith. This application is assigned Ser. No. 10/306,784.

In this system a compressor 22 delivers a refrigerant to a condenser 24. From the condenser 24 the refrigerant passes through an expansion device 25, and then enters an evaporator 26. From the evaporator the refrigerant is returned to the compressor 22. This is an over simplification of the entire refrigerant circuit, however, it will provide sufficient understanding for the present invention.

As shown, an oil sump 30 includes a level of oil which is delivered by an oil pump 32 back to the compressor 22. The lubricant is used within the compressor as known. A line 34 leads from a still or oil reclaim flow vaporizer 35 to the sump 30. The oil is separated and returned through line 34 to the oil sump from a mixed refrigerant/oil from line 50 led into the still from the evaporator. A hot discharge refrigerant boils the liquid refrigerant off of the refrigerant/oil mixture. The hot discharge refrigerant passes through an internal conduit within the vaporizer 35. This hot refrigerant boils the liquid refrigerant from the refrigerant/oil mixture. In this figure, the refrigerant being tapped is shown being tapped 33 from a main discharge line between the compressor and the condenser. It is also part of the proposed system that instead of this location, the refrigerant be alternatively tapped from the last lobe of the screw compressor. The refrigerant from the discharge tap, having heated the oil/refrigerant mixture, is returned to the evaporator by line 70. The refrigerant having been boiled out of either still 35, or separated otherwise in a sump 31 returns to the return line 69 either through line 71 or line 72. A hot oil return line 73 returns the oil from the compressor 22 back to the sump 30.

Again, this system has benefits as disclosed above. Again, as mentioned in alternative embodiments, the tapped refrigerant has been tapped from either the last lobe of the screw compressor, or directly from the discharge line. However, no selective control of this tapping has occurred.

Figure 2:
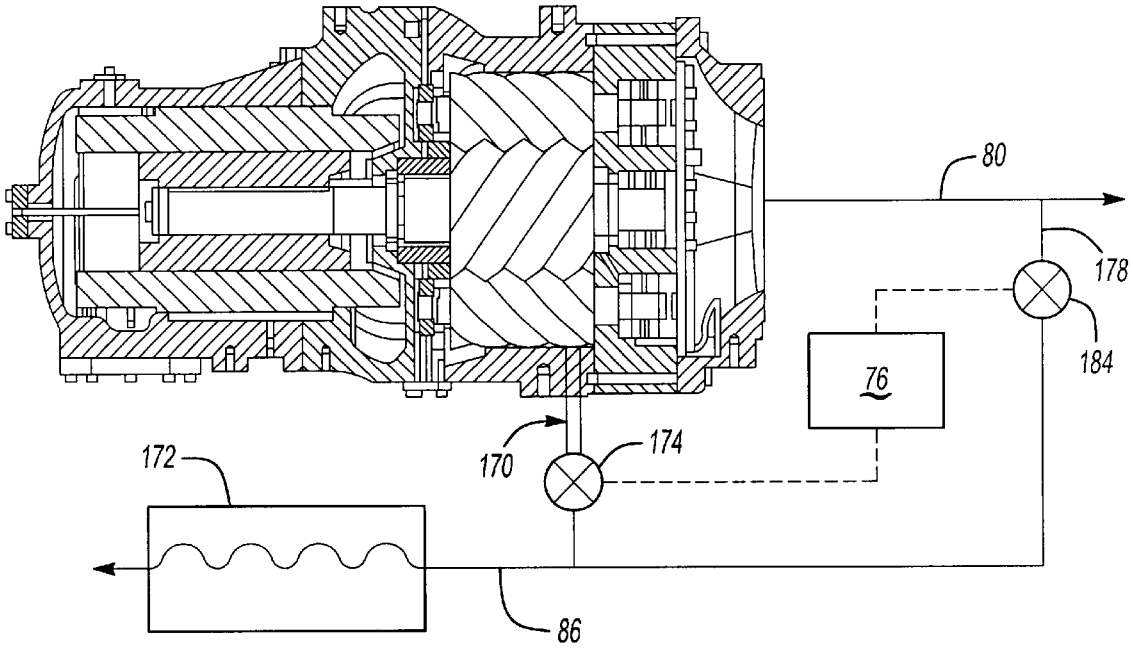
FIG. 2 shows the oil reclaim circuit of an inventive system.
Figure 3:
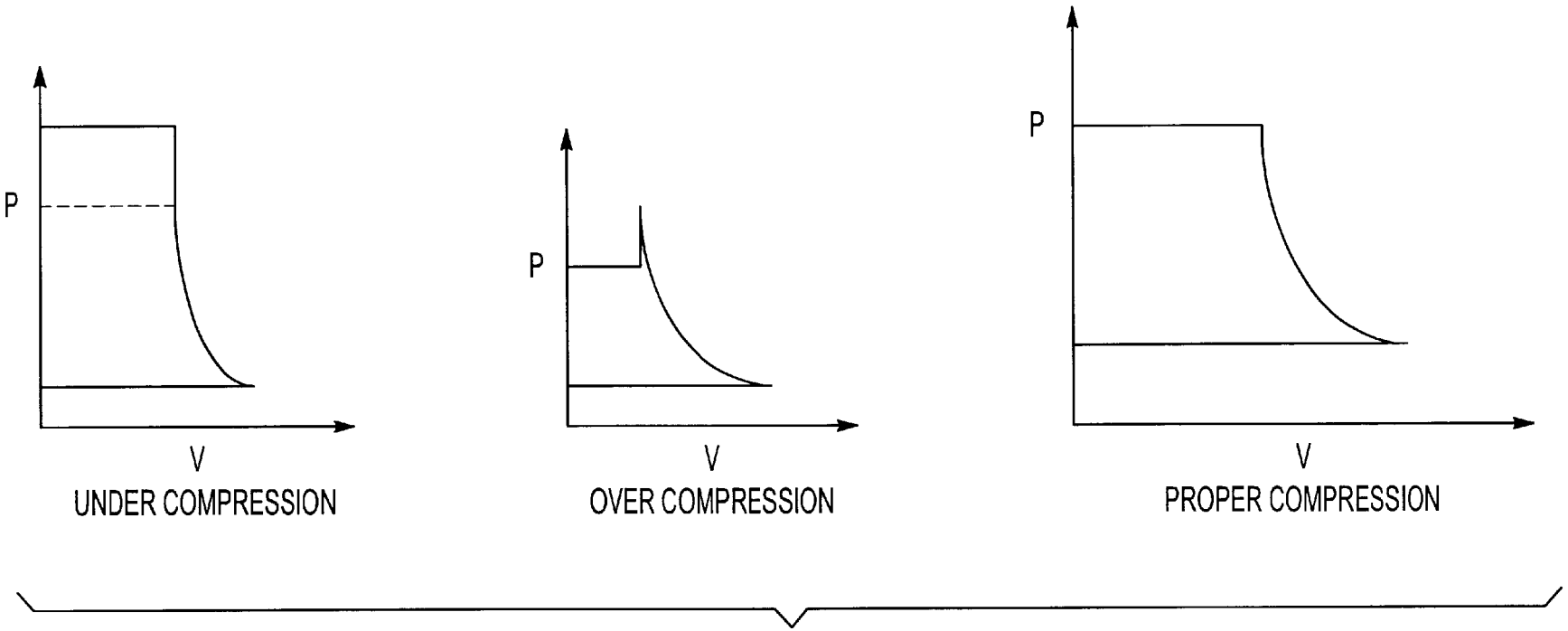
FIG. 3 shows P/V charts for several conditions.

As mentioned above, typically the refrigerant from the last lobe of the screw compressor would be the optimum refrigerant to tap. However, in under compression situations this refrigerant may not be sufficiently hot to adequately boil off the refrigerant. Thus, the present invention has selective supply of a tapped refrigerant. As shown in FIG. 2, a first line 170 leads from the last lobe of the screw compressor to tap refrigerant to the still 172. A valve 174 on this line is operated under the control of an electronic control 76, which may also be a part of the control for the compressor and the remainder of the refrigerant system. A second tap 178 is placed on the main discharge refrigerant line 80 leading to the condenser. This tap passes through a valve 184 before merging into a line 86 with the flow from the line 170. The control 76 alternatively opens one of the two valves 174 or 184 to deliver refrigerant from its respective taps to the still 172. As shown in FIG. 3, at any one load there may be proper compression, over compression or under compression. Typically in an under compression situation the load on the refrigerant system has lowered. The control would then typically begin to drive the compressor at a slower speed to reduce its output. Thus, at some point after an under compression situation, the compressor speed will typically be reduced such that the graph would approach the proper compression levels but at a different motor speed or load. However, in the transient between the under compression initially occurring and the speed changing, the control 76 will open the valve 84 and close the valve 74. In this situation refrigerant from the line 80 will be delivered to the still. In this way, the control 76 ensures that the optimum temperature refrigerant is being utilized to separate the oil from the liquid refrigerant.

At all other situations the valve 74 preferably remains open with valve 84 closed, and refrigerant from the last lobe of the screw compressor is delivered to the still. As shown, this tap 170 extends through the housing to communicate with the compression chamber at the last lobe.

The control for controlling the speed of the motor to achieve the proper compression is within the skill of a worker in this art. Moreover, the structure and operation of the valves and the control are also known. It is the use of a control to selectively control the two valves which is inventive here.

Although a preferred embodiment of this invention has been disclosed a worker in this art would recognize that modifications would come within the scope of this invention. For that reason the following claims should be studied to determine the true scope and content of this invention.

What is claimed is:

1. A method of operating a refrigerant cycle comprising the steps of:

1) providing a screw compressor for compressing a refrigerant and delivering a refrigerant to a condenser heat exchanger;

2) providing an evaporator heat exchanger for receiving a refrigerant from said condenser, said evaporator heat exchanger being operable to separate a liquid refrigerant/oil combination from a main refrigerant flow;

3) returning said separated liquid refrigerant/oil combination to a vaporizer;

4) tapping a portion of refrigerant compressed by said compressor to said vaporizer, and providing at least two taps at two distinct location for supplying said tap compressed refrigerant and passing said tap compressed refrigerant to said vaporizer to separate refrigerant from said refrigerant/oil combination; and 5) providing a control to selectively operate valves associated with each of said first and second taps to provide a discharge refrigerant at an desired temperature to said vaporizer based upon system conditions.

2. A method as set forth in claim 1, wherein one of said two taps leads to a chamber defined between lobes of said screw compressor and a second of said taps is connected to a line leading from said compressor to said condenser.

3. A method as set forth in claim 2, wherein said tap from said chamber between said lobes has its valve selectively open in a normal compression condition, with said valve on said line associated with said discharge line being opened when said compressor is compressing at a pressure which is below its optimum at a particular load.

4. A method as set forth in claim 1, wherein said separated refrigerant from said vaporizer is returned through a line leading back to said compressor.

5. A method as set forth in claim 1, wherein said separated oil from said vaporizer is returned to an oil sump.

6. A method as set forth in claim 5, wherein oil is delivered to said compressor by an oil pump and from said oil sump.

7. A refrigerant cycle comprising:

a screw compressor;

a condenser downstream of said screw compressor;

an evaporator downstream from said condenser, with the refrigerant passing from said compressor to said condenser, then to said evaporator, and back to said compressor;

said evaporator being operable to separate a liquid refrigerant/oil mixture from a refrigerant reaching said evaporator, said liquid refrigerant oil being delivered to a vaporizer, and a discharge pressure tap being associated with two locations, with each of said two taps including a valve, a control for selectively opening and closing each of said two valves, and said control monitoring system conditions to deliver refrigerant from one of said two taps to said vaporizer to boil off said refrigerant from said refrigerant/oil mixture based upon said system conditions.

8. A refrigerant cycle as set forth in claim 7, wherein one of said taps extends to a compression chamber within said compressor, and a second of said taps extends to a discharge line downstream of said compressor.

9. A refrigerant cycle as set forth in claim 8, wherein said tap within said compressor communicates with a last closed lobe of said compressor.

10. A refrigerant cycle as set forth in claim 7, wherein said control being operable based upon system conditions to select one of said two valves to open.

11. A refrigerant cycle as set forth in claim 10, wherein said control further controls a drive speed for said compressor, and said control opening said one of said two valves as a motor speed change is occurring.

12. A method as set forth in claim 1, wherein said control monitoring system conditions and selecting which one of said two valves to open.

13. A method as set forth in claim 12, wherein said control further controlling a drive speed for said compressor, and said control opening said one of said two valves as a motor speed change is occurring.

14. A method as set forth in claim 1, wherein said tapped portion of refrigerant is maintained separate from said liquid refrigerant/oil combination in said vaporizer.

15. A refrigerant cycle as set forth in claim 7, wherein said tapped refrigerant is maintained separate from said liquid refrigerant/oil mixture while in said vaporizer.

* * * * *